US005759275A

United States Patent [19]

Shostak

[11] Patent Number: 5,759,275

[45] Date of Patent: Jun. 2, 1998

[54] PORTABLE PAINT SHIELD, ATTACHABLE TO PAINT CAN

[76] Inventor: Walter G. Shostak, 124 W. 26th St., Bayonne, N.J. 07002

[21] Appl. No.: 603,739

[22] Filed: Feb. 20, 1996

[51] Int. Cl.[6] ..... B05C 21/00

[52] U.S. Cl. ..... 118/504; 118/505; 206/562; 206/563; 248/346.03

[58] Field of Search ..... 118/504, 505; 206/562, 563; 229/904, 905; 220/737, 738; 348/346.03

[56] References Cited

U.S. PATENT DOCUMENTS

| | | | |
|---|---|---|---|
| 2,301,216 | 11/1942 | Koontz | 248/346.03 |
| 2,314,935 | 3/1943 | Gutterman | 206/563 |
| 4,325,323 | 4/1982 | Rioux | 118/504 |
| 4,736,488 | 4/1988 | Nielsen | 118/504 |
| 4,846,100 | 7/1989 | Montoya | 118/504 |
| 4,998,696 | 3/1991 | Disjardins | 248/346.03 |
| 5,056,458 | 10/1991 | Askeland | 118/505 |
| 5,156,411 | 10/1992 | Owens | 280/79.2 |

*Primary Examiner*—Laura Edwards

[57] ABSTRACT

A portable paint shield that is attached to a paint can (60), having a unitary planar board (30) with a hole (40) in the center. The hole (40) is approximately the size of the circumference of the paint can (60). The unitary planar board (30) has a plurality of teeth-like protrusions (50) into the hole (40) to frictionally hold the board to the paint can (60). The device can be constructed from cardboard, corrugated paperboard and the like. The unitary planar board (30), when attached to a paint can (60) is conveniently placed and carried by the paint can (60). Thus providing a portable area of protection from paint drips, splatter, and access to the paint, in one motion.

5 Claims, 1 Drawing Sheet

PORTABLE PAINT SHIELD, ATTACHABLE TO PAINT CAN

FIELD OF INVENTION

This invention relates to painting shields, more specifically, a portable paint shield attachable to a paint can.

DESCRIPTION OF PRIOR ART

Heretofore, protecting surfaces from drips, splatter and spillage of paint range from tarps to old newspapers. The area to be protected is usually dictated by the total area to be painted. However, the majority of drips and splatter occur directly around the paint can. The paint brush is super-saturated after being dipped into the paint can. Therefore, a high concentration of drips and splatter occur wherever the can has been placed. Although these surfaces may have been protected, this concentration of drips, after the paint can has been moved, can easily be stepped on and tracked off the protected area.

Also, it is common to paint a small area or touch-up a multitude of spots in a large area. Spreading tarps or newspapers in these situations is time consuming and tedious, and often simply avoided.

Another common problem is knocking the paint can over or bumping it. The painter must continually turn away from the can to apply the paint. Spillage of paint or simply being cautious about the paint both slow down the painting process.

Some of these problems have been recognized and attempts have been made to solve them.

U.S. Pat. No. 4,846,100 to Montoya 1989, Jul. 11, describes an unfolding splatter board with an erectable paint vessel retainer. The time required to place and unfold the board is the same amount of time to place a tarp or newspaper. Also, the vessel retainer is U-shaped and erectable to frictionally hold the paint vessel with its springiness. Therefore, the force required force required to knock the can over must be greater than the frictional hold on the can, which is minimal. Also, this splatter board cannot be used on a ladder.

U.S. Pat. No. 4,325,323 to Rioux, 1982, Apr. 20, describes a three panel rigid paint splatter board. Two boards extend from each side of the central frame. The unit is mounted on casters. A clamp and bolts secure a paint vessel to the central frame. This device requires more time and energy to place than tarps or newspaper and is clearly more expensive. The three boards are of a rigid material, therefore requiring a clear path for movement along a wall. Also, the clamps and bolts used to secure the paint vessel are time consuming. This device also cannot be used on a ladder.

OBJECTS AND ADVANTAGES

Accordingly, several objects and advantages of my invention are:

(a) to provide a portable paint shield attached to the can of paint, that when placed under the area to be painted, provides access to the paint and an area of protection, in one motion.

(b) to provide protection directly around the can of paint from drips, regardless of where the can is placed, specifically, when the saturated brush is lifted from the can.

(c) to provide a paint shield that can continually be carried in the same motions the can of paint is normally carried. This includes hanging or placing it on a ladder.

(d) provide a paint shield that prevents the can of paint from being knocked over.

(e) provide a paint shield modifiable to accomadate any shaped vertical surface.

(f) provide the professional painter and the do-it-yourselfer an inexpensive, lightweight and disposable paint shield of a recycled material.

(g) provide a paint shield that gives the painter a sense of security concerning the anxieties associated with the spillage of paint. This sense of security, therefore causes the painter to perform more expeditiously.

Further objects and advantages of my invention will become apparent from a consideration of the drawings and ensuing description of it.

REFERENCE NUMERALS IN DRAWINGS

30 unitary planar board 50 teeth-like protrusions 70 paint can handle p0 40 hole 60 paint can

DESCRIPTION OF A PREFERRED EMBODIMENT OF THE INVENTION

Figure 1:
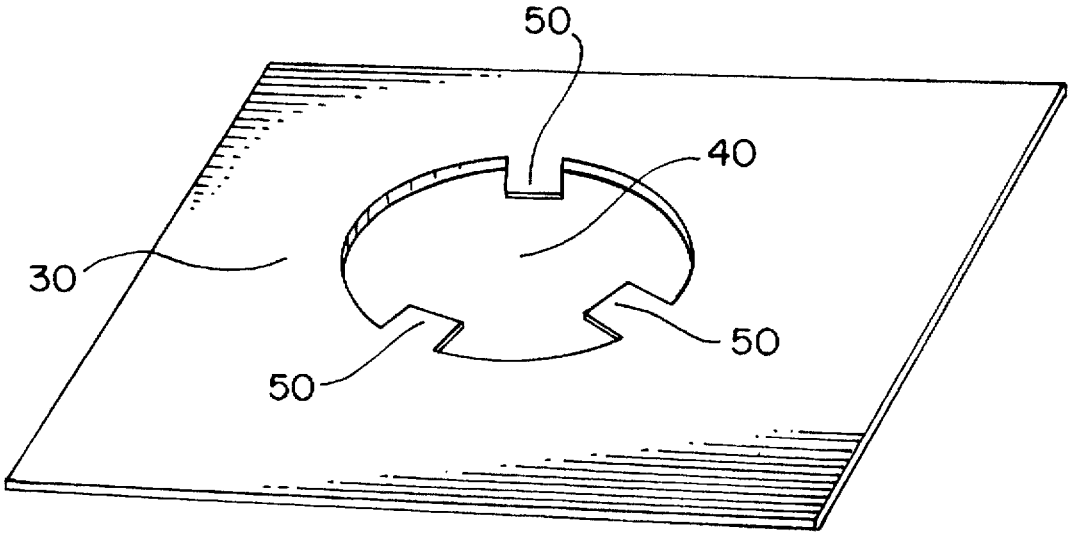
FIG. 1 shows a perspective view of the preferred embodiment.

A typical embodiment of the present invention is illustrated with a perspective view in FIG. 1. As seen therein, a portable paint shield, attachable to a paint can, which includes a unitary planar board (30) and a hole (40) in the center.

The unitary planar board (30) is generally rectangular. Its dimensions are roughly 42 cm by 60 cm. The hole (40) has a plurality of teeth-like protrusions (50) from the unitary planar board (30). Its circumference, in the preferred embodiment is roughly the circumference of a gallon paint can. The gallon size paint can is the most commonly used.

The preferred embodiment is constructable from a stiff to semi-rigid material such as cardboard, corrugated paperboard, plastic and the like.

OPERATION

Figure 2:
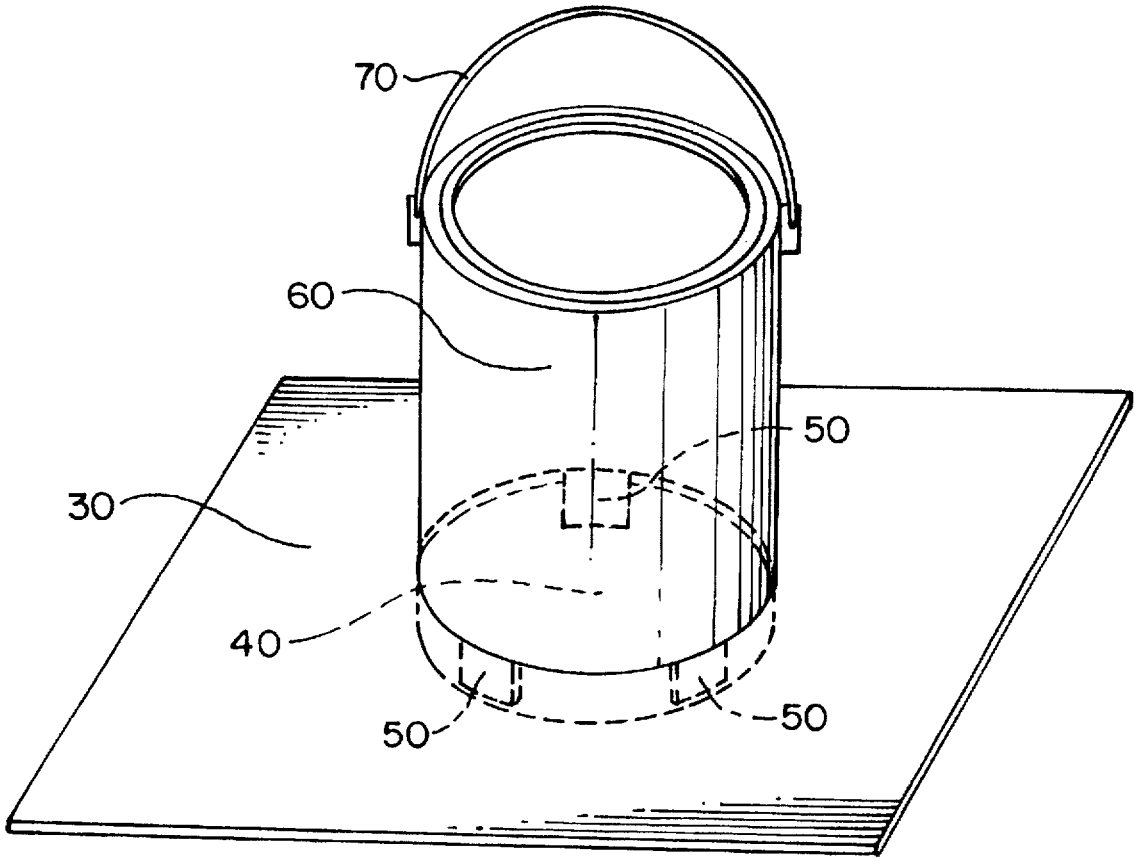
FIG. 2 shows a perspective view of the preferred embodiment with the paint can attached.

As seen in FIG. 2, a perspective view of the preferred embodiment attached to the paint can (60). In use, the portable paint shield is attached to the paint can (60) by placing it on a flat surface, then placing the bottom of the paint can (60) on top of the hole (40). Then with one hand holding the paint can handle (70) and the other hand holding the paint shield, simultaneously lift both and rotate the paint can (60). Then with both hands holding the paint shield, lift it approximately 2 cm to 3 cm. The teeth-like protrusions (50) will bend downward to frictionally hold the paint shield to the paint can (60). Optimally, the shield should be placed at the lowest possible place on the paint can (60). The paint can (60) with the paint shield attached is now one unit and can be conveniently placed and carried by the paint can handle (70), in one motion, with one hand. It can be placed under the area to be painted and continually moved, thus providing an area of protection and access to the paint, in one motion. The unitary planar board (30) can also be used to carry paint brushes, rags and the like.

The preferred embodiment is constructable from a stiff to semi-rigid material. Therefore, it is modifiable to acommadate any vertical edge. A razor blade or a knife can be used to cut either end of the unitary planar board (30) to accept stair stringers, door portals, to name a few. A modification could be made on one end to accept a door portal and the other end to accept stair stringers, for example.

The present invention is lightweight, inexpensive, disposable and preferrably made of a recycled material. However, it can be used repeatedly. Eventually, it can be inverted when attached to the paint can (60) so that the teeth-like protrusions (50) bend in the opposite direction.

During use, the invention can be placed on, or hung from a ladder. It also could be placed anywhere a paint can (60) would normally be placed. In addition, the paint can (60) with the paint shield attached could be placed on a slope or uneven surface. The unitary planar board (30) acts as an extended base of the paint can (60), therefore preventing the paint can (60) from being knocked over. When the paint can (60) is struck with a sudden lateral force, this force is dispersed throughout the unitary planar board (30).

CONCLUSION

Thus the reader will see that the portable paint shield, attachable to a paint can, provides a highly reliable, versatile, yet economical device which can be used by persons of any painting skill level.

While my above description contains many specifities, these should not be construed as limitations on the scope of the invention, but rather as an exemplification of one preferred embodiment thereof Many other examples are possible. For example, the invention could be constructed for any size container, such as 5 gallon, 2 gallon, quart, or pint, to name a few. Although paint is specified, any surface coating such as tar, glue, etc., could be used. Also, a smaller version made of an edible substance could be used attached to an ice cream cone to catch drips.

Accordingly, the scope of the invention should be determined not by the embodiment illustrated, but by the appended claims and their legal equivalents.

I claim:

1. A portable paint shield attachable to a paint can comprising: a semi-rigid unitary planar board having a first surface, a second surface, and periphery edges, said board having a central portion comprising an opening, said opening including radially extending protrusions, said protrusions extending radially toward a central axis, said protrusions being bendable in an upward direction to provide use of the board as a shield on the first surface and said protrusions being bendable in a downward direction to provide use of the board as a shield on an opposite surface, said opposite surface being said second surface, wherein said protrusions engage said paint can to provide a friction fit to enable the paint can and board to be carried simultaneously and said board being of a size to prevent the paint can from spilling over and provide protection to the work surface about the paint can.

2. The invention of claim 1 wherein said unitary planar board comprises cardboard.

3. The invention of claim 1 wherein said unitary planar board comprises corrugated paperboard.

4. The invention of claim 1 wherein said unitary planar board is generally rectangular.

5. The invention of claim 1 wherein said unitary planar board is generally square.

* * * * *